US008282446B2

(12) United States Patent
Sulea et al.

(10) Patent No.: US 8,282,446 B2
(45) Date of Patent: Oct. 9, 2012

(54) GUARD ATTACHMENT DEVICE

(75) Inventors: Maria-Margareta Sulea, Leinfelden-Echterdingen (DE); Stefan Heess, Leinfelden-Echterdingen (DE); Juergen Wiker, Hangzhou/Bing Jiang District (CN); Peter Stierle, Pliezhausen (DE)

(73) Assignee: Robert Bosch GmbH, Stuttgart (DE)

( * ) Notice: Subject to any disclaimer, the term of this patent is extended or adjusted under 35 U.S.C. 154(b) by 889 days.

(21) Appl. No.: 12/095,781

(22) PCT Filed: Apr. 19, 2007

(86) PCT No.: PCT/EP2007/053822

§ 371 (c)(1),
(2), (4) Date: Jun. 2, 2008

(87) PCT Pub. No.: WO2007/144219

PCT Pub. Date: Dec. 21, 2007

(65) Prior Publication Data

US 2008/0280549 A1 Nov. 13, 2008

(30) Foreign Application Priority Data

Jun. 14, 2006 (DE) ..... 10 2006 027 576

(51) Int. Cl.
*B24B 55/04* (2006.01)

(52) U.S. Cl. ..... 451/451; 451/452

(58) Field of Classification Search ..... 451/451, 451/452

See application file for complete search history.

(56) References Cited

U.S. PATENT DOCUMENTS

| | | | | | |
|---|---|---|---|---|---|
| 3,969,856 | A * | 7/1976 | Zerrer | 451/451 |
| 4,924,635 | A * | 5/1990 | Rudolf et al. | 451/344 |
| 5,163,252 | A * | 11/1992 | Garner et al. | 451/451 |
| 5,386,667 | A * | 2/1995 | Hausslein et al. | 451/344 |
| 5,637,035 | A * | 6/1997 | Yee | 451/358 |
| 5,766,062 | A * | 6/1998 | Edling | 451/451 |
| 7,063,606 | B2 | 6/2006 | Stierle et al. | |
| 7,311,589 | B2 | 12/2007 | Wiker | |
| 7,892,075 | B2 * | 2/2011 | Esenwein | 451/451 |
| 2006/0052041 | A1 | 3/2006 | Wiker | |
| 2008/0207098 | A1 * | 8/2008 | Andrasic et al. | 451/451 |

FOREIGN PATENT DOCUMENTS

| | | |
|---|---|---|
| CH | 682 732 | 11/1993 |
| DE | 37 42 430 | 6/1989 |
| DE | 39 13 898 | 10/1990 |
| DE | 41 13 641 | 10/1992 |
| DE | 42 39 367 | 5/1994 |
| DE | 296 01 002 | 6/1997 |
| DE | 299 03 177 | 5/1999 |
| DE | 101 58 334 | 2/2003 |
| DE | 102 59 520 | 7/2004 |
| DE | 103 43 060 | 4/2005 |
| DE | 10 2004 034 441 | 2/2006 |
| EP | 0 322 626 | 7/1989 |
| EP | 0 812 657 | 12/1997 |
| EP | 0 978 353 | 2/2000 |
| GB | 2 346 580 | 8/2000 |

* cited by examiner

*Primary Examiner* — Maurina Rachuba
(74) *Attorney, Agent, or Firm* — Michael J. Striker

(57) ABSTRACT

The invention is based on a protective hood fastening device having a fastening element (12*a*-12*n*) for fastening a protective hood (14*a*-14*n*) which is intended for partly enclosing a rotating application tool on a body (16*a*-16*n*) of an electric tool (10*a*-10*n*). It is proposed that the fastening element (12*a*-12*n*) comprise at least one latching element (18*a*-18*n*) for locking the protective hood (14*a*-14*n*) against rotation relative to the body (16*a*-16*n*) of the electric tool (10*a*-10*n*).

19 Claims, 16 Drawing Sheets

GUARD ATTACHMENT DEVICE

RELATED ART

Figure 1:
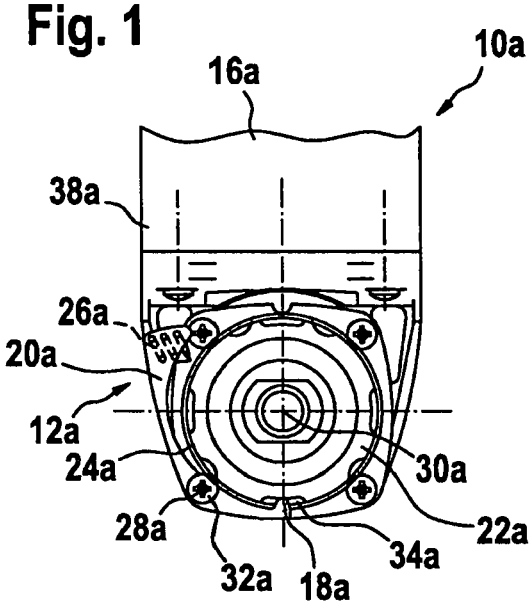

The present invention is directed to a guard attachment device according to the preamble of claim 1.

A guard attachment device with a fastening element for attaching a guard to a body of a power tool is known, the guard being provided to partially enclose a rotating insertion tool. The fastening element is designed as a loop and connects a fixed spindle support of the power tool in a non-positive manner with a guard spindle support when the loop is tightened around both spindle supports, e.g., using a clamping device that is actuatable using an Allen wrench.

ADVANTAGES OF THE INVENTION

The present invention is directed to a guard attachment device with a fastening element for attaching a guard to a body of a power tool, the guard being provided to partially enclose a rotating insertion tool.

It is provided that the fastening element includes at least one detent element for preventing the guard from rotating relative to the body of a power tool.

A tool-free assembly or adjustment of the guard may be attained when the guard fastening device includes at least one handling element for manually releasing a snap-in connection established via the detent element between the body of the power tool and the guard. In this context, the term "handling element" refers to any manually-operated assembly element, in particular levers and buttons.

It is possible to attain a transfer of force from easily-accessed regions to less easily-accessed regions using a simple design, and to advantageously transfer the force applied by the operator based on the lever principle when the handling element is designed as a lever or at least includes a lever-type extension.

A robust radial fastening with a simple design may be attained when the guard attachment device includes a spindle support mounted on the body of the power tool for radially and axially securing the guard, and when it particuarly advantageously includes a guard spindle support that is provided to establish a plug connection with the spindle support of the power tool.

The ability of the guard to swivel or rotate is not impaired when the guard spindle support and the spindle support have corresponding, cylindrical jacket-shaped surfaces that are suitable for establishing a radially secured, rotatable plug connection between the guard spindle support and the spindle support.

A robust, dust-proof, and cost-favorable rotation lock may be attained when the detent element is designed as a detent cam.

Further cost savings may be attained by simplifying assembly and reducing the large number of components when the detent element is designed as one piece with the handling element, and particularly advantageously when it is designed as a plastic, injection-molded part.

Greater security due to a redundant rotation lock may be ensured by providing at least is two detent elements for preventing the guard from rotating relative to the body of the power tool.

This applies, in particular, when a handling element—that is used to manually release a snap-in connection established by the detent element—is assigned to each of the detent elements. Over-complication of the operation resulting from this duplication may be prevented when the two handling elements or the two engagement points of the handling elements are located directly next to each other, so that the operator need use only one finger to actuate both handling elements.

As an alternative, the two handling elements may be located on opposite sides of the body of the power tool, and they may have opposing directions of actuation, so that the operator need use only the thumb and index finger of one hand, or the thumb and middle finger of one hand for actuation.

Axial fastening may be attained using a simple design with a rearward attachment to axially secure the guard on the body of the power tool.

When the guard attachment device includes a spring element for loading the handling element in the direction of a detent position, it is possible to prevent an accidental release of the detent element or the snap-in connection established by the detent element.

A robust rotation lock may also be realized by designing the detent element to include at least one eccentric cam for establishing the snap-in connection between the guard and the body of the power tool.

A particularly high level of rotation prevention may be ensured by designing the detent element to include toothing that has a matching toothing on the guard.

When the handling element is supported on the body of the power tool such that it may swivel about a swivel axis, support and retention are ensured that have simple designs and are dust-proof.

An associated lever may be designed to extend in the circumferential direction in a space-saving manner when the swivel axis extends at least essentially parallel to a rotation axis of the insertion tool. In this context, "essentially parallel" also refers to a configuration in which the directions of the axes deviate from each other by less than 10°-20°.

As an alternative, it is provided that the swivel axis forms an angle with a rotation axis of the insertion tool. This makes it possible to obtain play for the handling element that is adapted to the particular design.

It is possible to attain a snap-in direction of the handling element and/or detent element that extends transversally to a rotation direction of the insertion tool, in particular a cutting disk, when the swivel axis extends at least essentially perpendicularly to a rotation axis of the insertion tool.

Due to the particularly great risk of the insertion tool shattering when used with this power tool, the improvement in the operational reliability attained via the inventive guard attachment device is particularly effective when the power tool is designed as an angle grinder.

The present invention also relates to a guard for attachment to a body of the power tool, and to its enclosing—at least partially radially—a rotating insertion tool that is insertable in the power tool.

According to the inventive refinement of the guard, it is provided that it includes a detent recess for preventing the guard from rotating relative to the body of the power tool.

According to the inventive refinement of the guard, it is provided that the guard includes a detent recess for preventing the guard from rotating relative to the body of the power tool. Particularly advantageously, the guard has a regular series of detent recesses located equidistantly apart, which detent recesses may also form toothing that continues periodically in the circumferential direction of the guard and/or the guard spindle support.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

Figure 2:
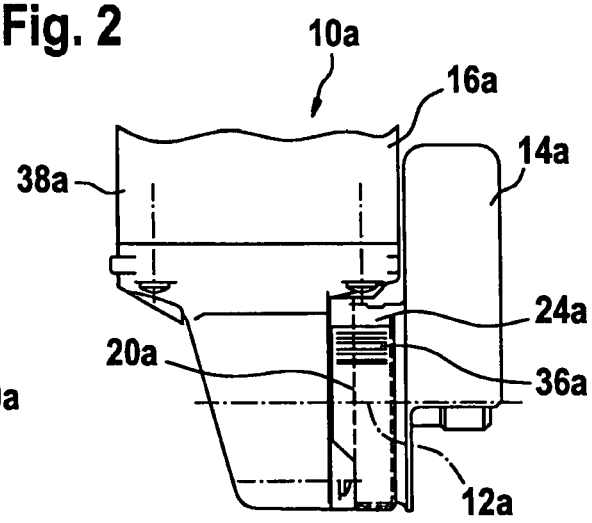
Figure 3:
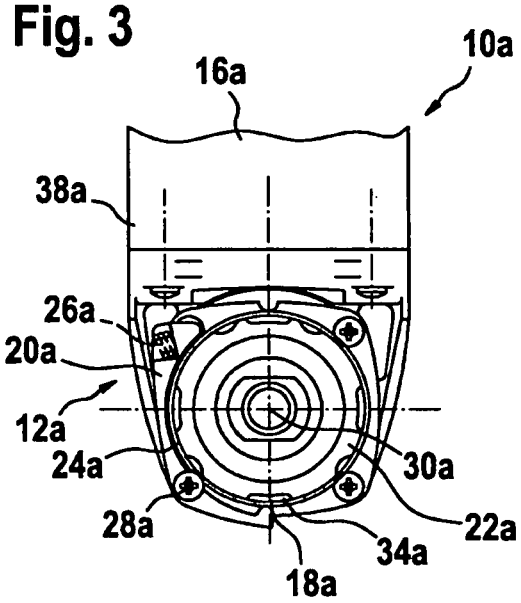
Figure 4:
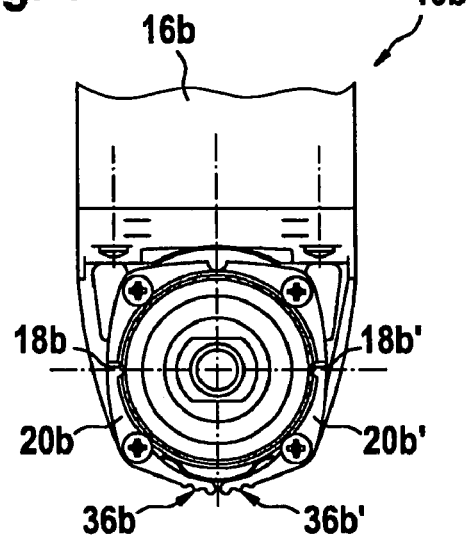
Figure 5:
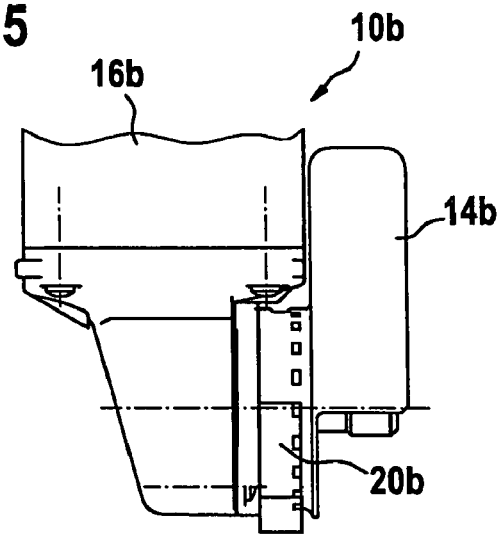
Figure 6:
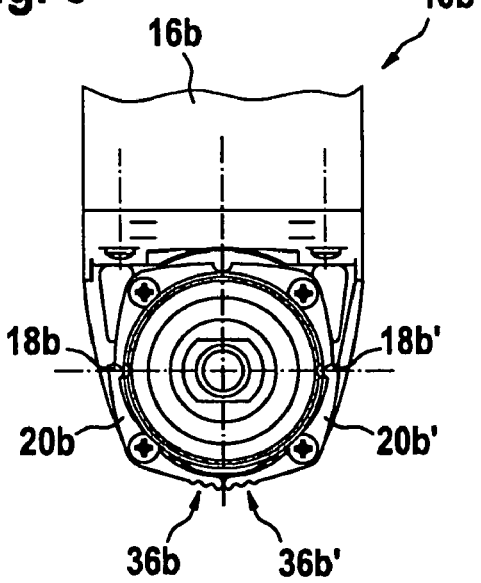
Figure 7:
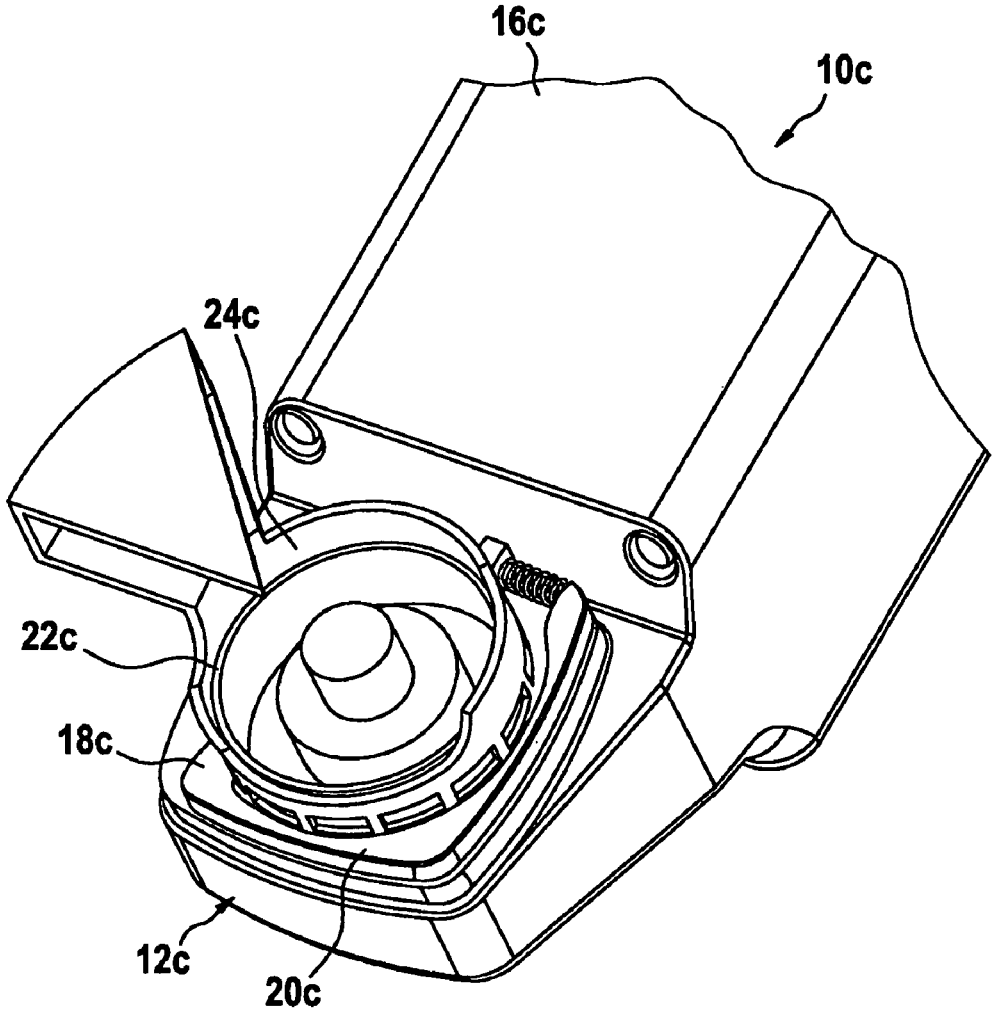
Figure 8:
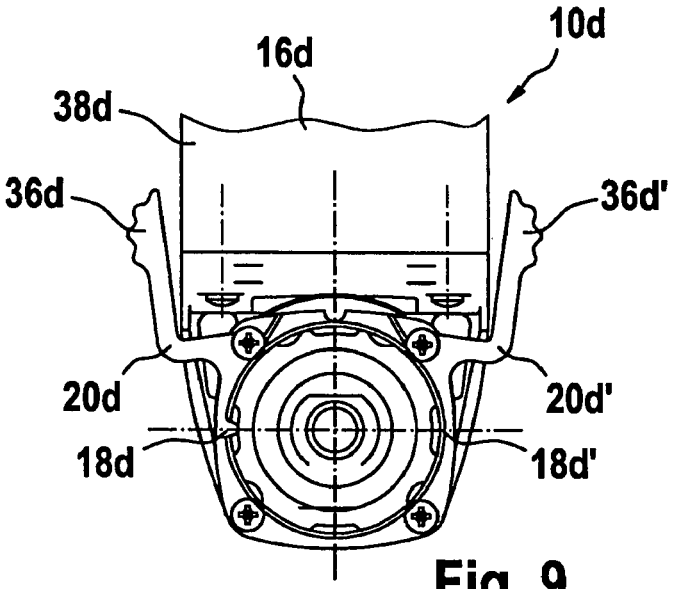
Figure 9:
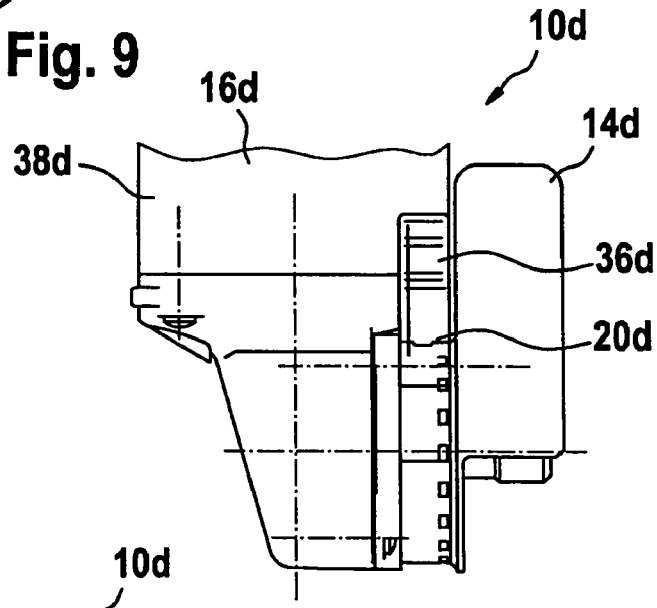
Figure 10:
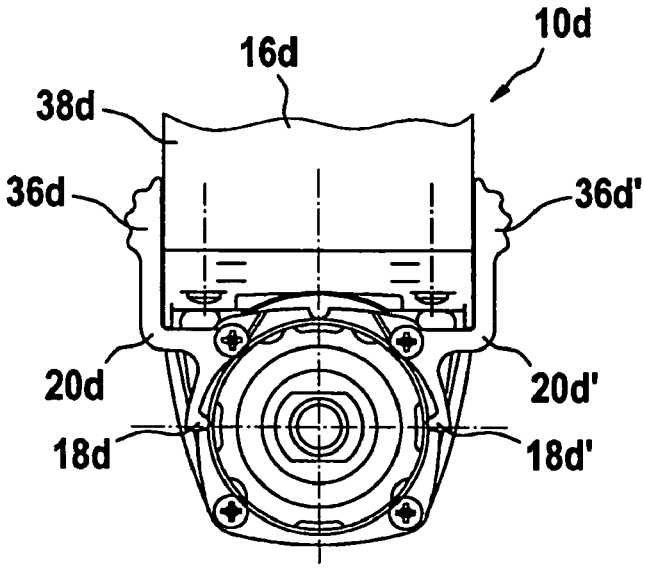
Figure 11:
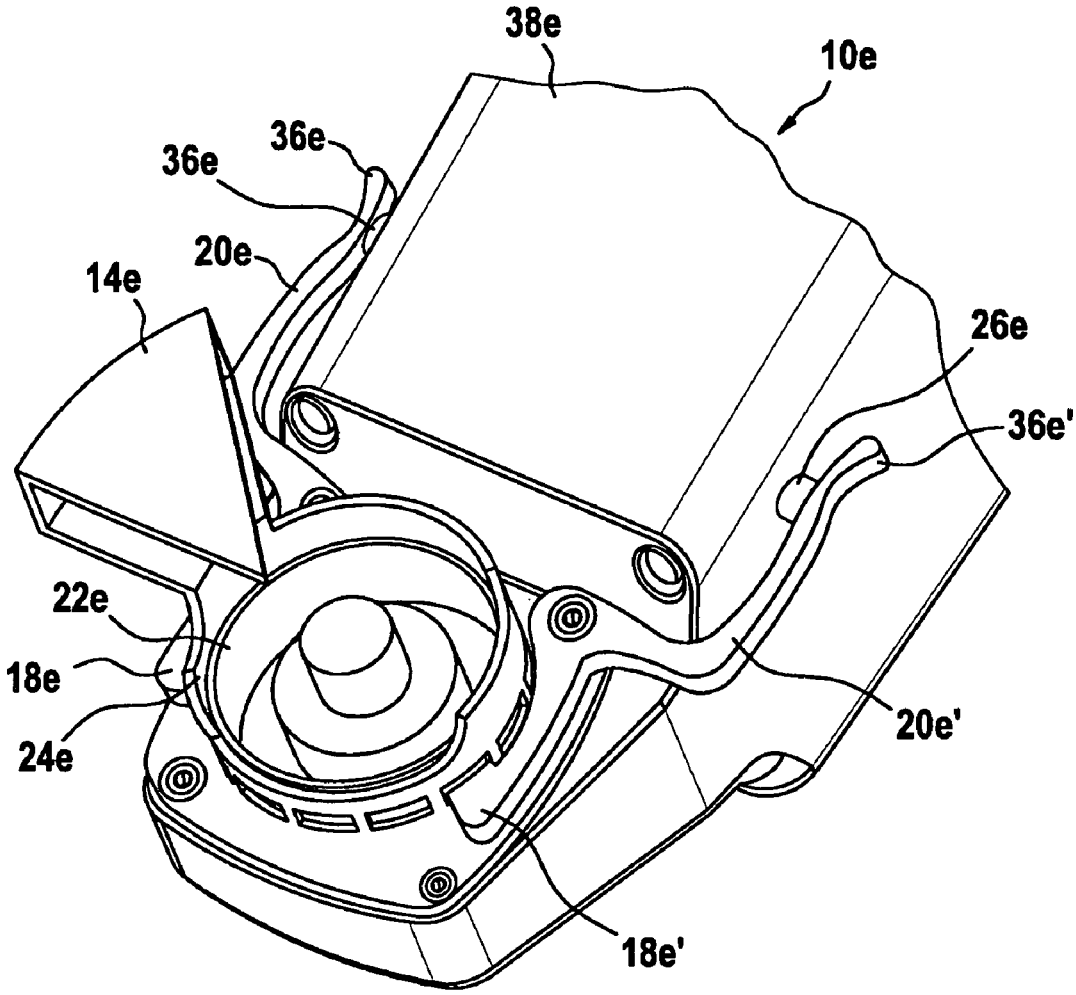
Figure 12:
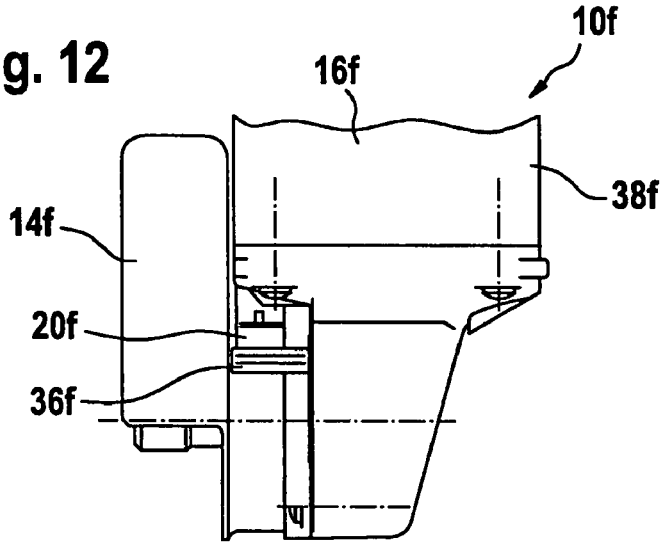
Figure 13:
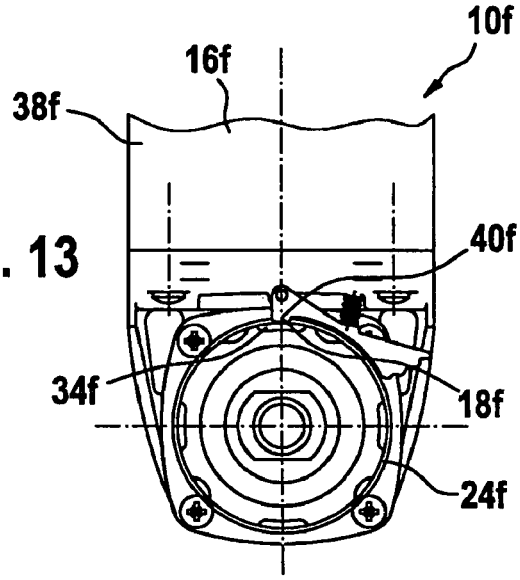
Figure 14:
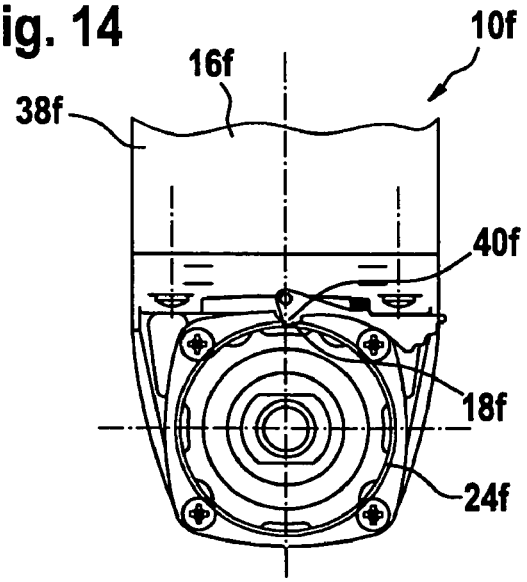
Figure 15:
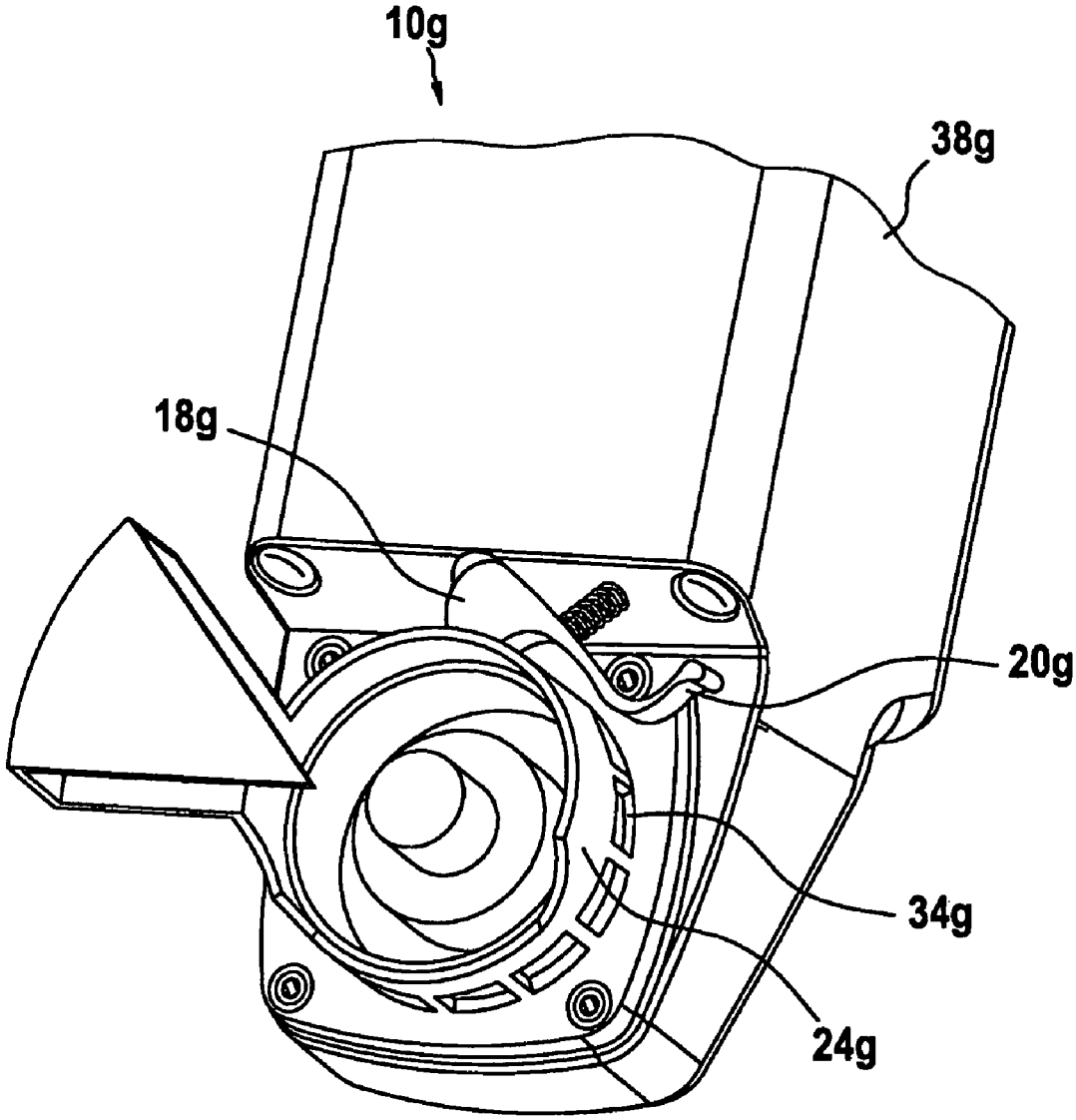
Figure 16:
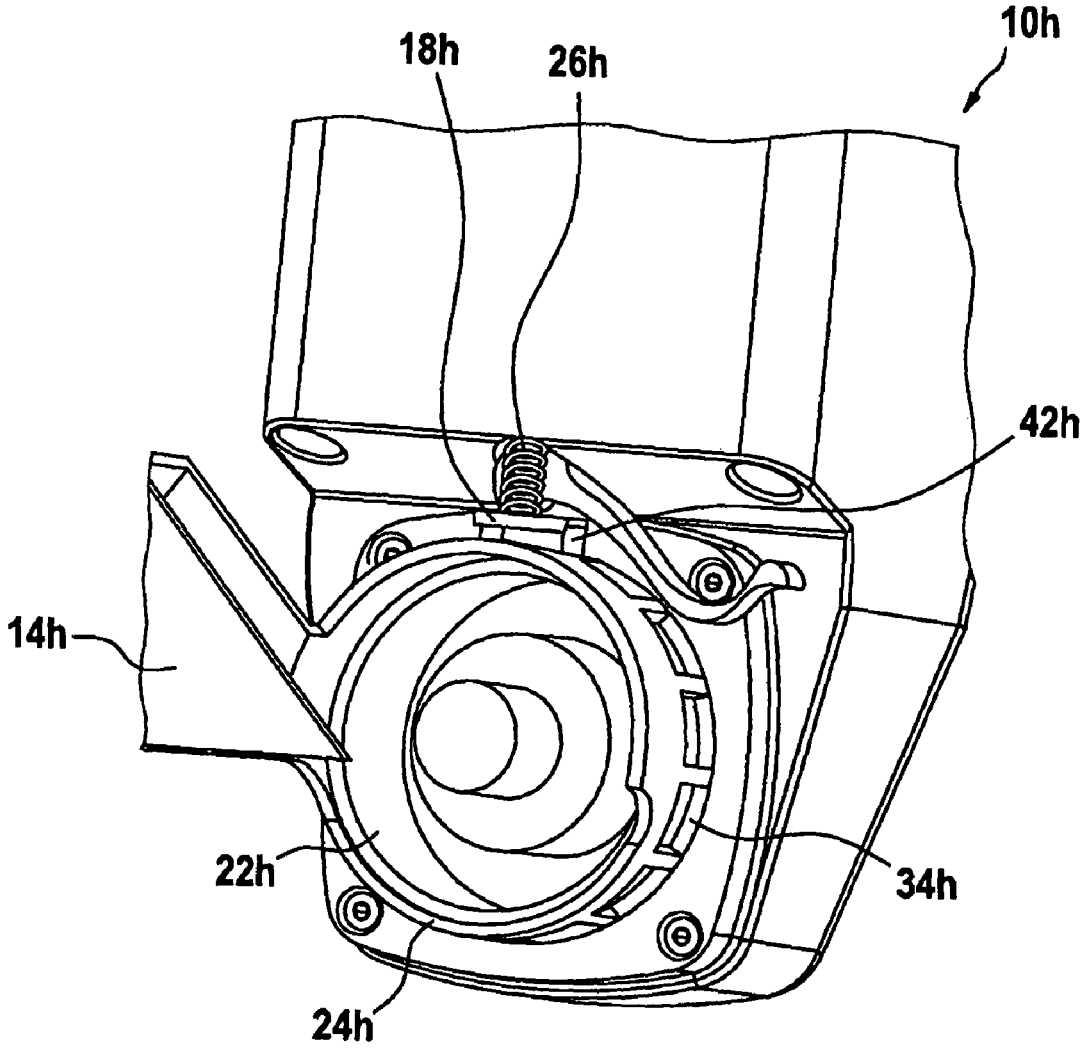
Figure 17:
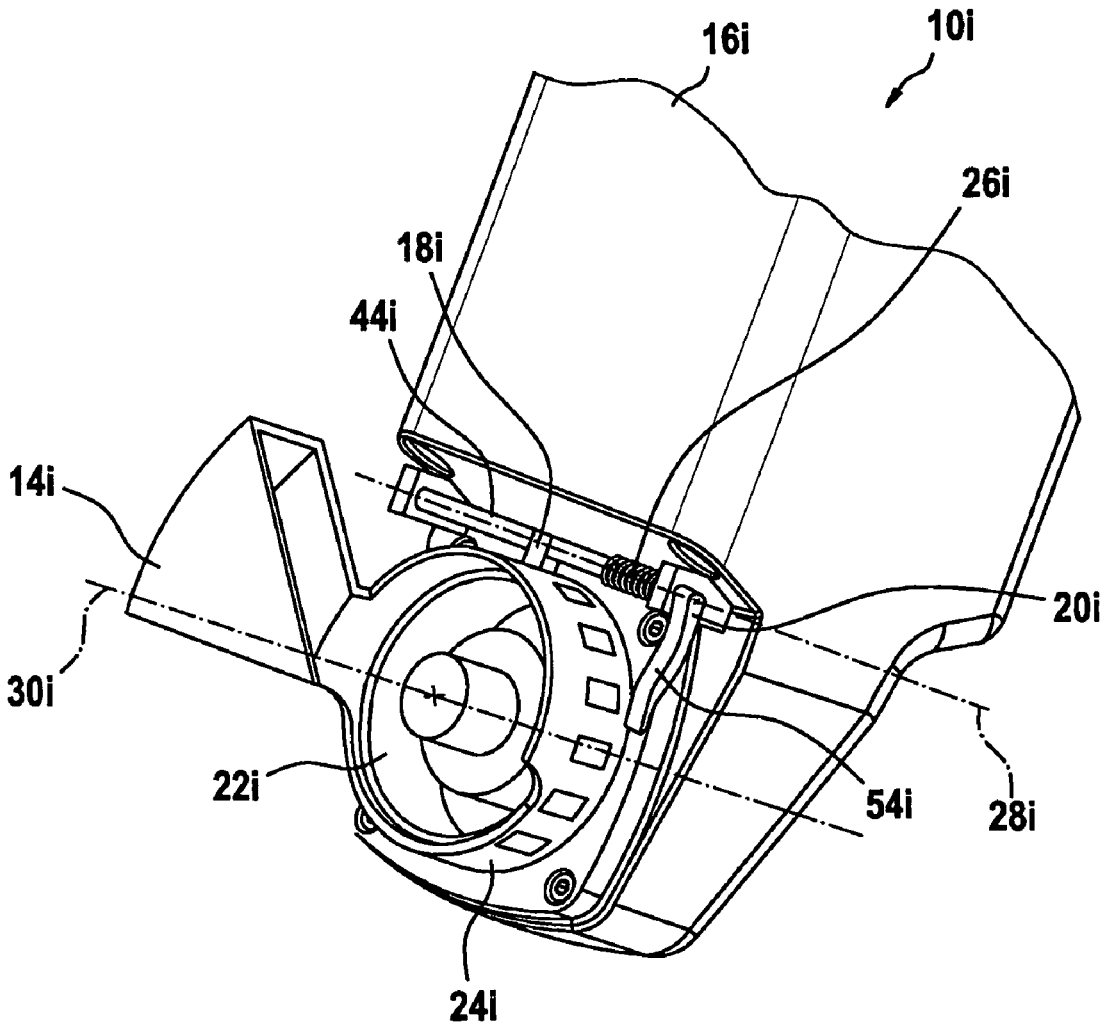
Figure 18:
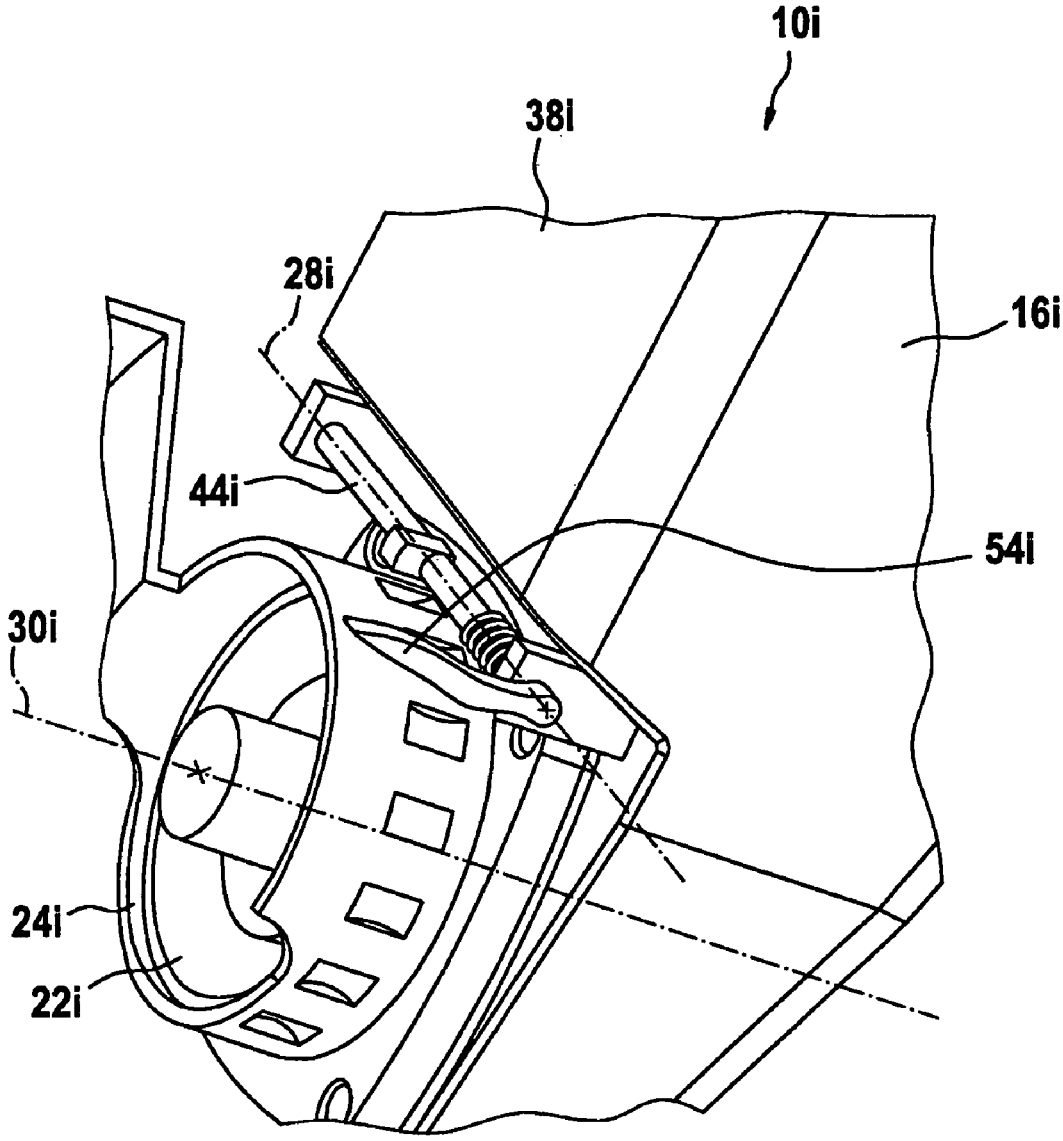
Figure 19:
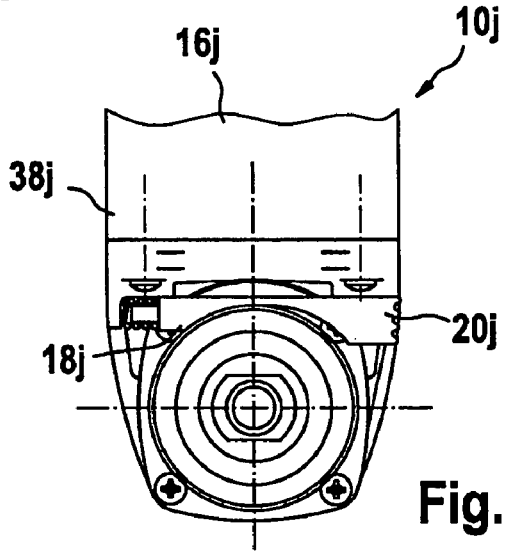
Figure 20:
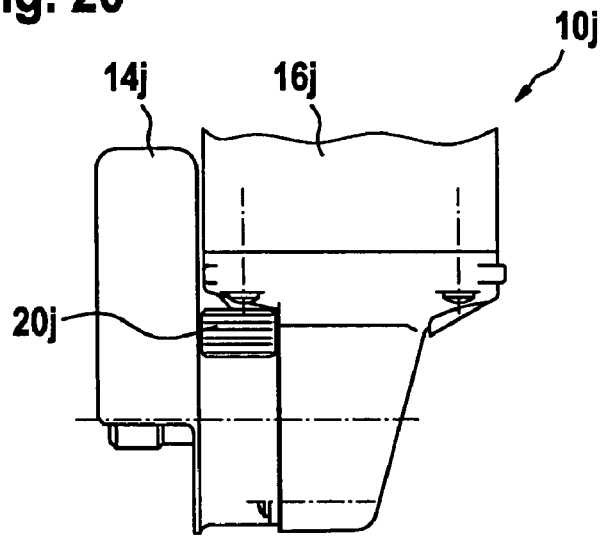
Figure 21:
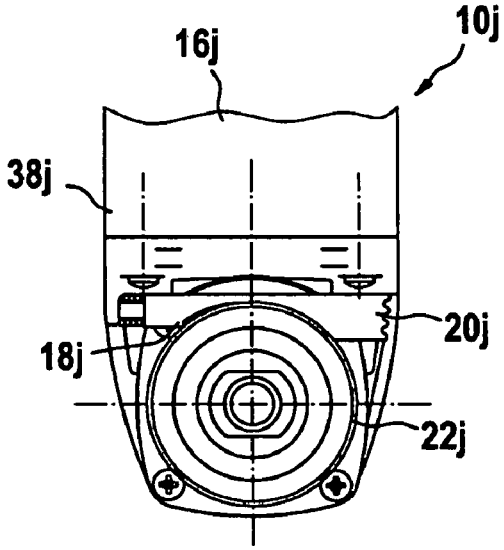
Figure 22:
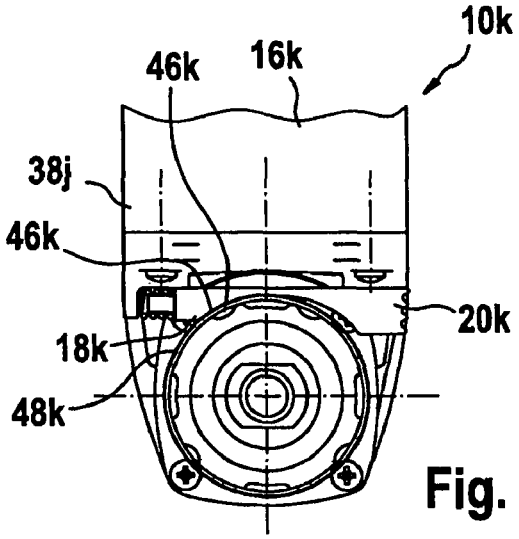
Figure 23:
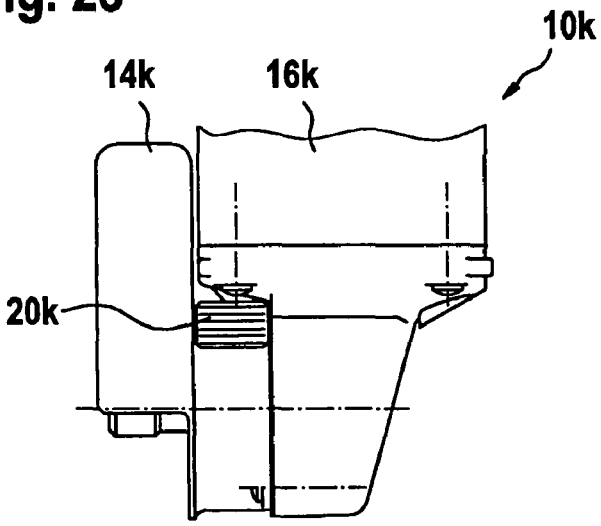
Figure 24:
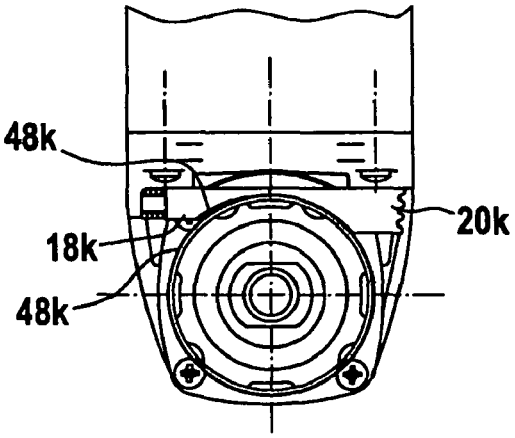
Figure 25:
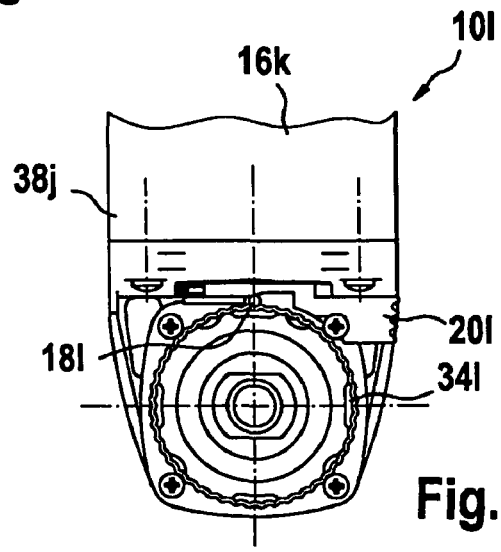
Figure 26:
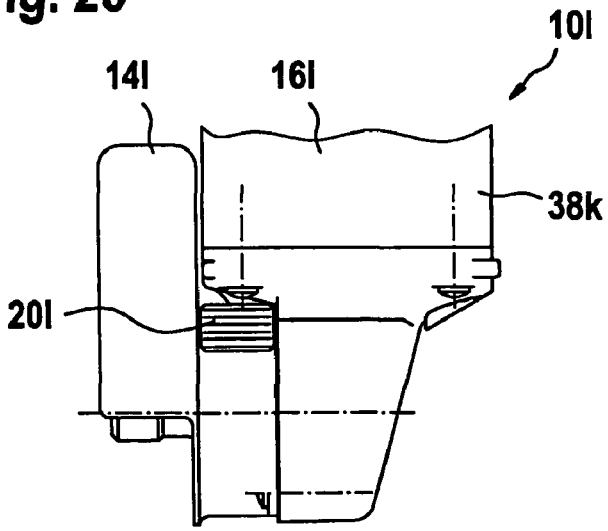
Figure 27:
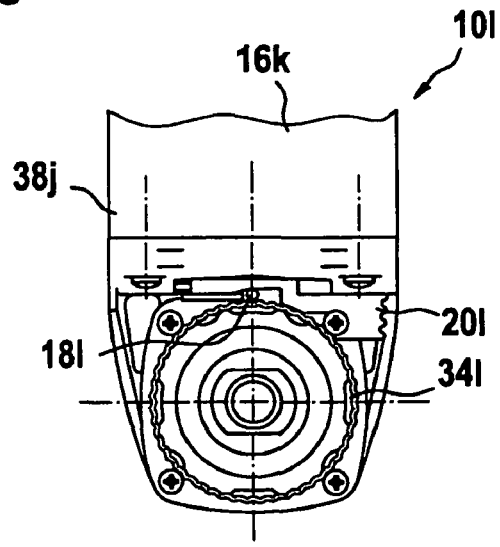
Figure 28:
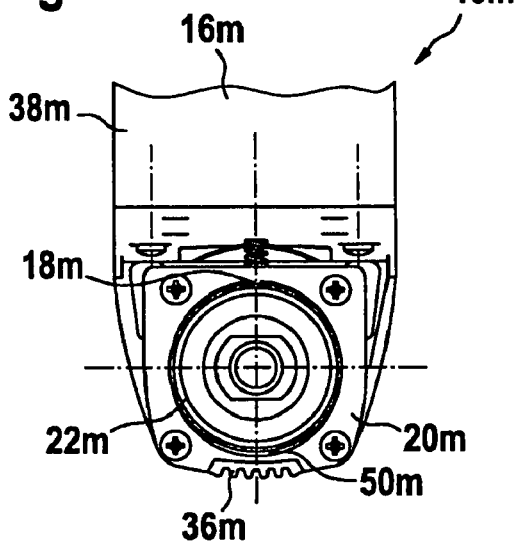
Figure 29:
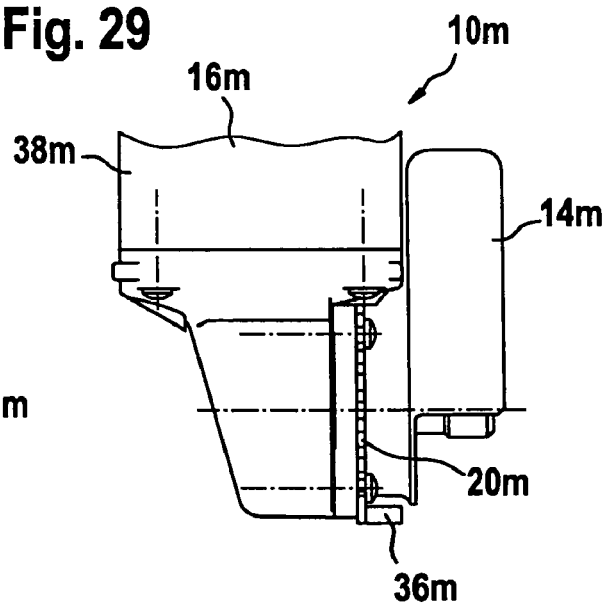
Figure 30:
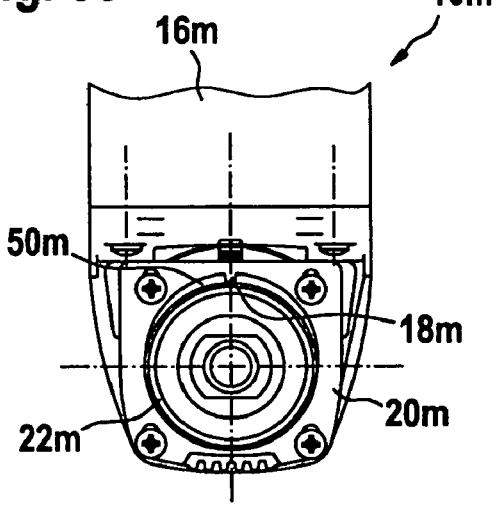
Figure 31:
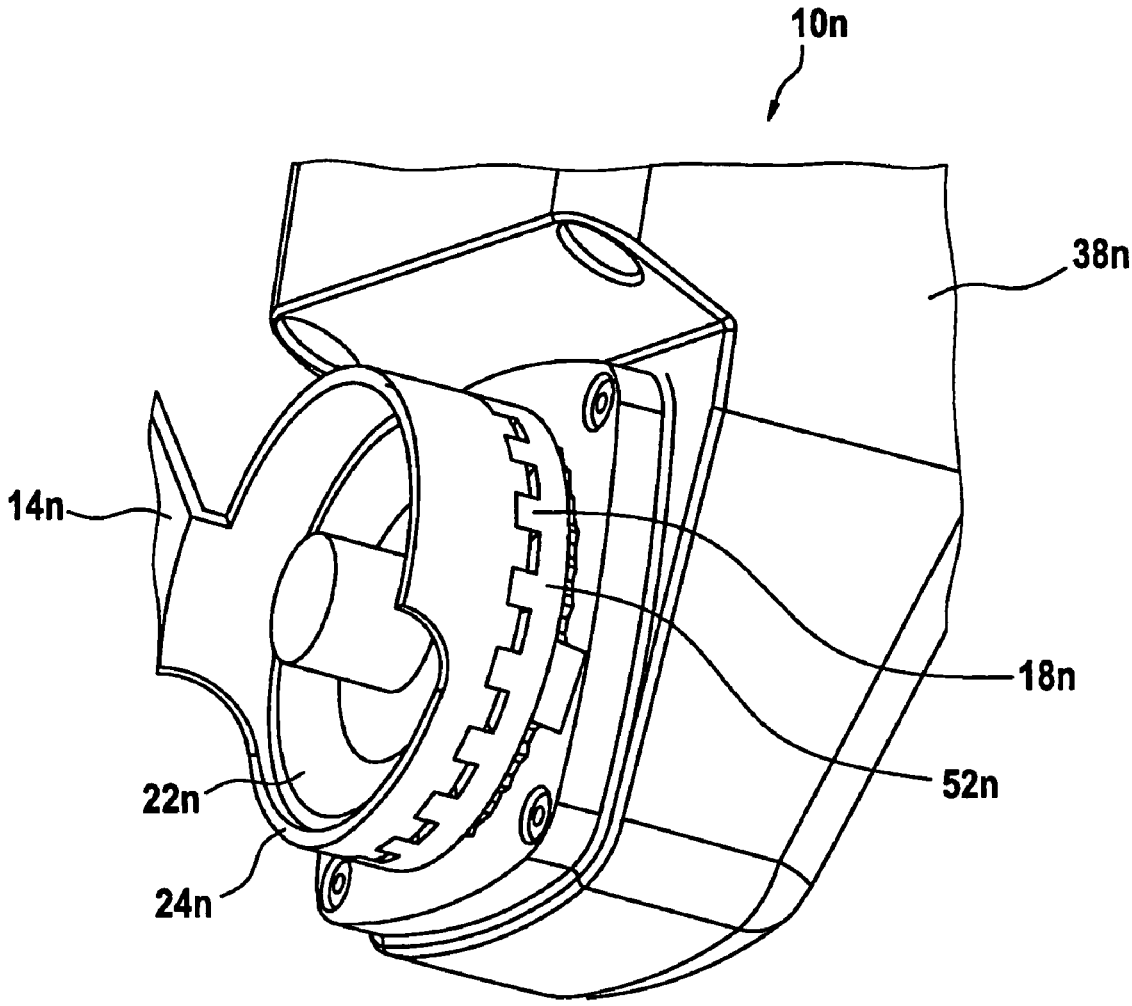
Figure 32:
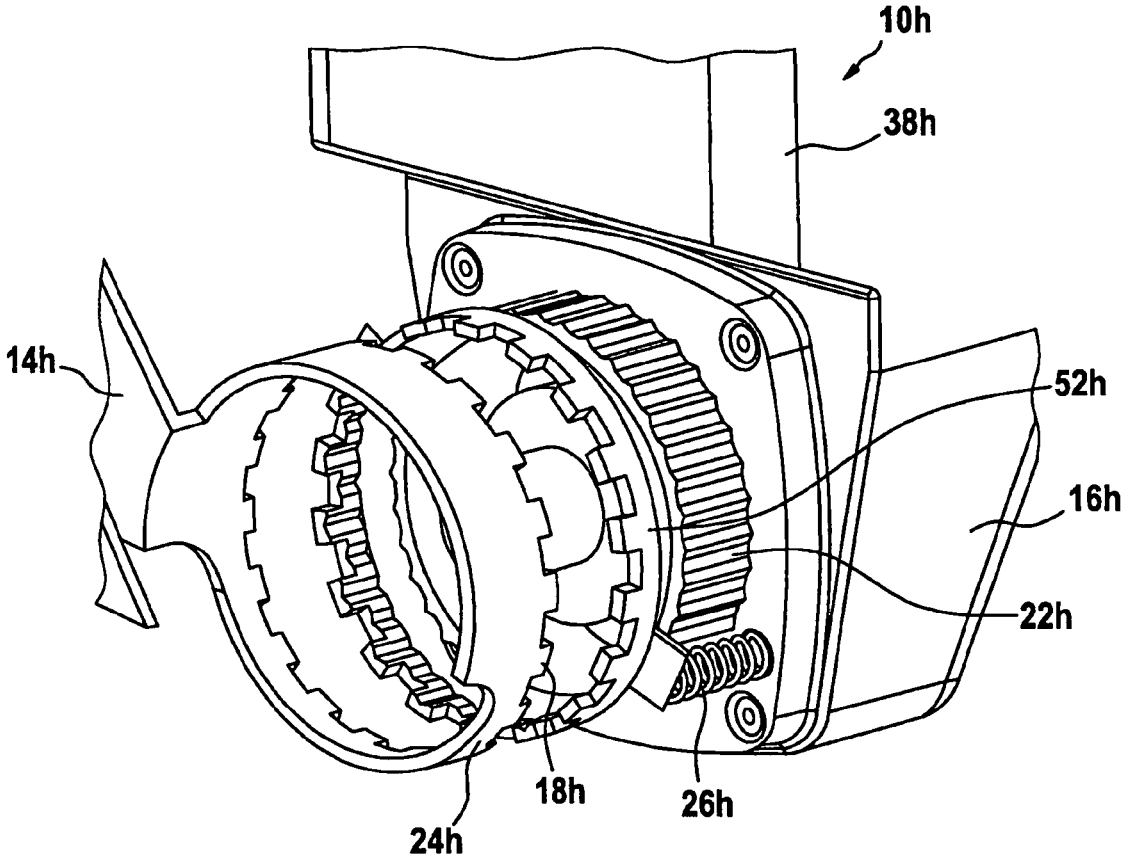

FIG. 1 shows a section of an angle grinder with a guard attachment device with a detent element according to a first exemplary embodiment of the present invention, FIG. 2 shows the section in FIG. 1 in a side view, with a guard, FIG. 3 shows the section in FIG. 1 with the detent element released, FIG. 4 shows a section of an angle grinder with a guard attachment device with two detent elements according to a second exemplary embodiment of the present invention, FIG. 5 shows the section in FIG. 4 in a side view, with a guard, FIG. 6 shows the section in FIG. 4 with detent elements released, FIG. 7 shows a section of an angle grinder with a guard attachment device with a detent element, and with a particularly long handling element, according to a third exemplary embodiment of the present invention, FIG. 8 shows a section of an angle grinder with a guard attachment device with a detent element according to a fourth exemplary embodiment of the present invention, FIG. 9 shows the section in FIG. 8 a side view, with a guard, FIG. 10 shows the section in FIG. 8 with the detent element released, FIG. 11 shows a section of an angle grinder with a guard attachment device with a detent element according to a fifth exemplary embodiment of the present invention, FIG. 12 shows a section of an angle grinder with a guard attachment device with a detent element, which is designed as an eccentric cam, according to a sixth exemplary embodiment of the present invention, FIG. 13 shows the section in FIG. 12 a side view, with a guard, FIG. 14 shows the section in FIG. 12 with the detent element released, FIG. 15 shows a section of an angle grinder with a guard attachment device with a detent element according to a seventh exemplary embodiment of the present invention, FIG. 16 shows a section of an angle grinder with a guard attachment device with a detent element and a gliding element, according to an eighth exemplary embodiment of the present invention, FIG. 17 shows a section of an angle grinder with a guard attachment device with a detent element according to a ninth exemplary embodiment of the present invention, FIG. 18 shows the section in FIG. 17 with the detent element released, FIG. 19 shows a section of an angle grinder with a guard attachment device with a detent element, with a handling element that is displaceable along a straight line, according to a tenth exemplary embodiment of the present invention, FIG. 20 shows the section in FIG. 19 a side view, with a guard, FIG. 21 shows the section in FIG. 19 with the detent element released, FIG. 22 shows a section of an angle grinder with a guard attachment device with a detent element according to an eleventh exemplary embodiment of the present invention, FIG. 23 shows the section in FIG. 22 a side view, with a guard, FIG. 24 shows the section in FIG. 22 with the detent element released, FIG. 25 shows a section of an angle grinder with a guard attachment device with a detent element according to a twelfth exemplary embodiment of the present invention, FIG. 26 shows the section in FIG. 25 a side view, with a guard, FIG. 27 shows the section in FIG. 25 with the detent element released, FIG. 28 shows a section of an angle grinder with a guard attachment device with a detent element according to a thirteenth exemplary embodiment of the present invention, FIG. 29 shows the section in FIG. 28 a side view, with a guard, FIG. 30 shows the section in FIG. 28 with the detent element released, FIG. 31 shows a section of an angle grinder with a guard attachment device with a detent element according to a fourteenth exemplary embodiment of the present invention, and FIG. 32 shows the section in FIG. 31 with a section of a guard, in an exploded view.

DESCRIPTION OF THE EXEMPLARY EMBODIMENTS

FIG. 1 shows a guard attachment device of a power tool 10*a*, namely an angle grinder, with a fastening element 12*a* for attaching a guard 14*a* to a body 16*a* of power tool 10*a*. Guard 14*a* is designed to partially enclose a rotating insertion tool (not shown) in the radial direction and in the circumferential direction. In the circumferential region, in which guard 14*a*—which is circular when viewed axially from the top—covers the insertion tool, which is designed as a cutting disk in the present exemplary embodiment, guard 14*a* encloses a radially outer cutting edge of the insertion tool via a U-shaped profile.

Guard 14*a* protects an operator from injuries that could occur due to pieces flying outwardly in the radial direction that would be produced, in particular, if the insertion tool would shatter. Guard 14*a* also provides protection against sparks, which may be produced when working with power tool 10*a*.

To produce a power tool 10*a* with a guard 14*a* that is easy to attach and release, and whose rotational position is adaptable to the particular circumstances, fastening element 12*a* includes at least one detent element 18*a* for preventing guard 14*a* from rotating relative to body 16*a* of power tool 10*a*.

A tool-free assembly or adjustment of guard 14*a* is attained by designing the guard fastening device to include a handling element 20*a* for manually releasing a detent connection established via detent element 18*a* between body 16*a* of power tool 10*a* and guard 14*a*, handling element 20*a* being designed as a lever or having two lever-type extensions.

To secure guard 14*a* radially, the guard attachment device includes a spindle support 22*a* mounted on a body 16*a* of power tool 10*a*, and a guard spindle support 24*a*, which is provided to establish a plug connection with spindle support 22*a* of power tool 10*a*.

A rearward attachment of guard spindle support 24*a*, which is not shown explicitly here, serves to secure guard 14*a* axially on body 16*a* of power tool 10*a*. The rearward attachment includes openings for the insertion of guard spindle support 24*a* on tool-side spindle support 22*a*, and tool-side spindle support 22*a* has matching openings, thereby ensuring that insertion may take place only in certain relative rotational positions defined by the openings.

In addition, guard spindle support 24*a* and spindle support 22*a* have corresponding, cylindrical jacket-shaped surfaces that are suitable for establishing a radially secured, rotatable plug connection between guard spindle support 24*a* and spindle support 22*a*.

Detent element 18*a* is a plastic injection-molded part that is integrally formed as a single piece at one end of one of the lever arms of handling element 20*a*, and it is designed as a detent cam. As an alternative, detent element 18*a* may also be designed, e.g., as an aluminum diecast part, or as a punched part.

Spring element 26*a*, which is designed as a compression spring in the present exemplary embodiment, serves to load handling element 20*a* in the direction of a detent position.

Handling element 20*a* is supported on body 16*a* of power tool 10*a* such that it may swivel about a swivel axis 28*a*, which extends parallel to a rotation axis 30*a* of the insertion tool. In the present exemplary embodiment, swivel axis 28*a* coincides with a central axis of a screw 32*a*, with which machine-side spindle support 22*a* is screwed together with a housing of power tool 10*a*, which is designed as an angle grinder. In other feasible embodiments of the present invention, swivel axis 28*a* and the central axis of screw 32*a* do not coincide.

FIG. 2 shows the section in FIG. 1 in a side view, with guard 14*a* installed. Guard 14*a* has a large number of detent openings 34*a* on guard spindle support 24*a*, which are shown in FIGS. 1 and 2, and each of which is assigned to a rotational position of guard 14*a* relative to body 16*a*.

FIG. 3 shows the section in FIG. 1 with detent element 18*a* released. An operator may release detent element 18*a* by applying a radially inwardly-acting force in the region of spring element 26*a*, in an engagement region 36*a* of handling element 20*a*, which force overcompensates for a restoring force of radially outwardly-acting spring elements 26*a*. Detent element 18*a* and engagement region 36*a* are located on opposite ends of handling element 20*a*, which is curved and extends around nearly one-third of the circumference of spindle support 22*a*. Swivel axis 28*a* of handling element 20*a* is located in a central region of the same, between detent element 18*a* and engagement region 36*a*. When engagement region 36*a* of handling element 20*a* is pressed radially inwardly, detent element 18*a* therefore moves radially outwardly.

When detent element 18*a* has been released, guard spindle support 24*a* and spindle support 22*a* or guard 14*a* and power tool 10*a* may be rotated in opposing directions, and the matching, cylindrical jacket-shaped surfaces glide over each other, thereby guiding the resultant rotational motion. Detent element 18*a* also glides over one of the jacket surfaces, until a detent recess 34*a* is reached, in which detent element 18*a* engages, driven by the restoring force of spring element 26*a*.

FIGS. 4 through 32 show further exemplary embodiments of the present invention. The descriptions of these figures mainly address the differences from the exemplary embodiment presented in FIGS. 1 through 3. Reference is made to the descriptions of FIGS. 1 through 3 for features that are the same. Similar features are provided with the same reference numerals, appended with the letters a-m to distinguish between the exemplary embodiments.

FIGS. 4 through 6 show a section of an angle grinder with a guard attachment device with two detent elements 18*b*, 18*b*' according to a second exemplary embodiment of the present invention. Guard attachment device includes two essentially mirror-symmetrical detent elements 18*b*, 18*b*' for preventing guard 14*b* from rotating relative to body 16*b* of power tool 10*b*. A lever-type handling element 20*b*, 20*b*' is assigned to each of the detent elements 18*b*, 18*b*'. Using lever-type handling element 20*b*, 20*b*', it is possible to manually release a snap-in connection established by detent element 18*b*. Engagement regions 36*b*, 36*b*' of the two handling elements 20*b*, 20*b*' are located directly next to each other.

FIG. 6 shows the section in FIG. 4 with detent elements 18*b*, 18*b*' released. It is clear that the two detent elements 18*b*, 18*b*' may be released simultaneously by simultaneously pressing the two engagement regions 36*b*, 36*b*'. In an alternative embodiment of the present invention that is not shown here, engagement regions 36*b*, 36*b*' are located radially one over the other, so that, when first handling element 20*b* is actuated, second handling element 20*b*' is automatically carried along.

FIG. 7 shows a section of an angle grinder with a guard attachment device with a detent element 18*c* according to a third exemplary embodiment of the present invention. The guard attachment device according to the third exemplary embodiment of the present invention has a lever-type handling element 20*c* with two lever arms, which are connected via a common swivel axis 28*c*, handling element 20*c* extending over half of the circumference of a spindle support 22*c* of the guard attachment device, and each of the lever arms extending around nearly one-fourth of the circumference of spindle support 22*c*.

FIGS. 8 through 10 show a section of an angle grinder with a guard attachment device with two detent elements 18*d*, 18*d*' and two handling elements 20*d*, 20*d*', according to a fourth exemplary embodiment of the present invention. Engagement regions 36*d*, 36*d*' of handling elements 20*d*, 20*d*' are displaced radially outwardly and, when in a release position shown in FIG. 10, they abut a housing 38*d* of a power tool 10*d*, which includes the guard attachment device.

FIG. 11 shows a section of an angle grinder with a guard attachment device with two detent elements 18*e*, 18*e*' and two handling elements 20*e*, 20*e*' according to a fifth exemplary embodiment of the present invention, in which spring elements 26*e*, 26*e*' designed as compression springs are located, beneath engagement regions 36*e*, 36*e*' of handling elements 20*e*, 20*e*' and between particular handling element 20*e*, 20*e*' and a housing 38*e* of a power tool 10*e* that includes the guard attachment device.

FIGS. 12 through 14 show a section of an angle grinder with a guard attachment device with a detent element 18*f* according to a sixth exemplary embodiment of the present invention. Detent element 18*f* is designed as an eccentric cam for establishing the snap-in connection between guard 14*f* and body 16*f* of power tool 10*f*, which may be rotated around a rotation point using a lever arm. The rotation point is defined by a semi-cylindrical shape 40*f* on a housing 38*f* of a power tool 10*f* that includes the guard attachment device, against which a force used to push the eccentric cam into a corresponding detent recess 34*f* in guard spindle support 24*f* bears.

FIG. 15 shows a section of an angle grinder with a guard attachment device with a detent element 18*g* according to a seventh exemplary embodiment of the present invention, which—similar to the sixth exemplary embodiment of the present invention—includes an eccentric cam that engages in a detent recess 34*g* in a guard spindle support 24*g*. The eccentric cam is designed with two sides, however, so that the support of handling element 20*g* on a housing 38*g* of a power tool 10*g* that includes the guard attachment device takes place via a cam-shaped curved path.

FIG. 16 shows a section of an angle grinder with a guard attachment device with a detent element 18*h* according to an eighth exemplary embodiment of the present invention and with a two-sided eccentric cam that is analogous to the seventh exemplary embodiment, which, however, does not engage directly in a detent recess 34*h* in a guard spindle support 24*h*, but rather pushes a radially movable gliding element 42*h*—that is supported in the machine-side spindle support 22*h* such that it may be moved radially—into a detent recess 34*h* of this type, in order to lock guard 14*h* in position.

FIG. 17 shows a section of an angle grinder with a guard attachment device with a handling element 20*i* and a detent element 18*i* according to a ninth exemplary embodiment of the present invention.

Handling element 20*i* includes a button 54*i*, which is connected with a shaft 44*i*, for operating the detent device. Handling element 20*i* is swivelable about a swivel axis 28*i* defined by shaft 44*i*, swivel axis 28*i* forming an angle of 90° relative to a rotation axis 30*i* of the insertion tool and extending essentially tangentially to spindle support 22*i*. A detent element 18*i* is integrally formed with shaft 44*i*. Detent element 18*i* may be automatically rotated via a spring element 26*i* designed as a torsion spring into a detent recess 34*i* in a guard spindle support 24*i*. The detent connection therefore remains secure even when very large torques act on guard 141. FIG. 18 shows the section in FIG. 17 with detent element 18*i* released. In an alternative embodiment, shaft 44*i* may be designed as a torsion bar with restoring spring action, thereby making it possible to eliminate a separate spring element 26*i*.

FIGS. 19 through 21 show a section of an angle grinder with a guard attachment device with a detent element 18*j* according to a tenth exemplary embodiment of the present invention. A handling element 20*j* of the guard attachment device according to FIGS. 19 through 21 is supported on a housing 38*j* of a power tool 10*j* such that it is displaceable along its longitudinal direction, in a straight line and tangentially to spindle support 22*j*. A longitudinal guide of handling element 20*j* is designed as a strip gliding element.

FIGS. 22 through 24 show a section of an angle grinder with a guard attachment device with a detent element 18*k* according to an eleventh exemplary embodiment of the present invention, which also includes a handling element 20*k* that is displaceable along a straight line, tangentially to spindle support 22*k*. Detent element 18*k* includes a toothing 46*k* that corresponds with a matching toothing 48*k* of guard 14*k*, so that, in the locked position shown in FIG. 22, toothings 46*k*, 48*k* mesh and prevent guard 14*k* from rotating.

FIGS. 25 through 27 show a section of an angle grinder with a guard attachment device with a detent element 18*l* according to a twelfth exemplary embodiment of the present invention, which also includes a handling element 20*l* that is displaceable along a straight line, tangentially to spindle support 22*l*.

Detent element 18*l* is a ball that moves longitudinally in the direction of a rotation axis of an insertion tool along a path determined by handling element 20*l* or a wedge surface or a curved surface. When handling element 20*l* is in the non-actuated position in which it is acted upon by a spring, aforementioned surface locks the ball that has been pushed out on it, so that it engages in corresponding detent recesses 34*l* in guard spindle support 24*l*, thereby preventing guard 14*l* from rotating. The ball is captively supported on power tool 10*l*, independently of handling element 20*l*, thereby ensuring that it may not fall out even when guard 14*l* has been removed.

FIGS. 28 through 30 show a section of an angle grinder with a guard attachment device with a detent element 18*m* according to a thirteenth exemplary embodiment of the present invention. Detent element 18*m* is designed as an arresting projection on the inner circumference of a handling element 20*m* that encloses spindle support 22*m* of a power tool 10*m* in the manner of a frame, as a type of gliding plate. Handling element 20*m* is supported perpendicularly to rotation axis 30*m* of the insertion tool such that it may glide on housing 38*m* of power tool 10*m*. The inner circumference bounds a slot-shaped opening 50*m*.

FIG. 31 shows a section of an angle grinder with a guard attachment device with a detent element 18*n* according to a fourteenth exemplary embodiment of the present invention, and FIG. 32 shows the section in FIG. 31 with a section of a guard 14*n*, in an exploded view. A non-rotatable ring 52*n* that is acted upon by a spring and has an inner toothing is located in this guard attachment device, around fixed spindle support 22*n* of housing 38*n* of power tool 10*n* that includes guard attachment device. Installed guard 14*n* bears via an end face of guard spindle support 24*n* against the end face of this ring 52*n*. Both end faces are blocked in a rotation-proof manner via meshing detent elements 18*n* designed as toothing.

To enable guard to freewheel, ring 52*n* is displaced manually against a spring element 26*n*, thereby disengaging detent elements 18*n*. Guard 14*n* may then be rotated, in accordance with the distribution of the teeth. When spring element 26*n* is released, possibly in conjunction with a slight rotational motion of guard 14*n*, detent elements 18*n* engage once more. In the direction of action of spring element 26*n*, ring 52*n* is captively held on spindle support 22*n* by a not-shown stop. Suitable bevels provided on detent elements 18*n* may simplify automatic engagement.

In addition to compression springs, any types of springs that appear suitable to one skilled in the technical art may be used as spring elements, e.g., leaf springs, leg springs, coiled springs, or torsion bar springs.

What is claimed is:

1. A guard attachment device, comprising:

a fastening unit for attaching a guard (14*b*; 14*d*; 14*e*), which is provided to partially enclose a rotating insertion tool, to a body (16*b*; 16*d*; 16*e*) of a power tool (10*b*; 10*d*; 10*e*);

wherein the fastening unit includes at least two handling elements (20*b*, 20*b*'; 20*d*, 20*d*'; 20*e*, 20*e*') designed as levers, wherein the fastening unit further includes at least two detent elements (18*b*, 18*b*'; 18*d*, 18*d*'; 18*e*, 18*e*') for preventing the guard (14*b*; 14*d*; 14*e*) from rotating relative to the body (16*b*; 16*d*; 16*e*) of the power tool (10*b*; 10*d*; 10*e*);

wherein the at least two detent elements (18*b*, 18*b*'; 18*d*, 18*d*'; 18*e*, 18*e*') are mirror-symmetrically and movably arranged on the tool body (16*b*; 16*d*; 16*e*);

wherein the at least two handling elements (20*b*, 20*b*'; 20*d*, 20*d*'; 20*e*, 20*e*') designed as levers are provided for manually releasing a snap-in connection established by the detent elements (18*b*, 18*b*'; 18*d*, 18*d*'; 18*e*, 18*e*') between the body (16*b*; 16*d*; 16*e*) of the power tool (10*b*; 10*d*; 10*e*) and the guard (14*b*; 14*d*; 14*e*); and wherein to each of the at least two detent elements (18*b*, 18*b*'; 18*d*, 18*d*'; 18*e*, 18*e*') one of the at least two handling elements (20*b*, 20*b*'; 20*d*, 20*d*'; 20*e*, 20*e*') designed as levers is assigned.

2. The guard attachment device as recited in claim 1, characterized by a spindle support (22*a*-22*n*) attached to the body (16*a*-16*n*) of the power tool (10*a*-10*n*) for securing the guard (14*a*-14*n*) radially and axially.

3. The guard attachment device as recited in claim 2, characterized by a guard spindle support (24*a*-24*n*), which is provided to establish a plug connection with the spindle support (22*a*-22*n*) of the power tool (10*a*-10*n*).

4. The guard attachment device as recited in claim 2, wherein the guard spindle support (24*a*-24*n*) and the spindle support (22*a*-22*n*) have corresponding, cylindrical jacket-shaped surfaces that are suitable for establishing a radially secured, rotatable plug connection between the guard spindle support (24*a*-24n) and the spindle support (22*a*-22*n*).

5. The guard attachment device as recited in claim 1, wherein the detent element (18*f*-18*h*) includes at least one eccentric cam for establishing the snap-in connection between the guard (14*f*-14*h*) and the body (16*f*-16*h*) of the power tool (10*f*-10*h*).

6. The guard attachment device as recited in claim 1, wherein the handling element (20*a*-20*i*) is supported on the body (16*a*-16*i*) of the power tool (10*a*-10*i*) such that it may swivel about a swivel axis (28*i*-28*i*).

7. The guard attachment device as recited in claim 6, wherein the swivel axis (28*a*-28*h*) extends at least essentially parallel to a rotation axis (30*a*-30*h*) of the insertion tool.

8. The guard attachment device as recited in claim 6, wherein the swivel axis (28*i*) extends at least essentially perpendicularly to a rotation axis (30*i*) of the insertion tool.

9. The guard attachment device as recited in claim 1, wherein the power tool (10*a*-10*n*) is designed as an angle grinder.

10. A system, comprising:

a power tool (10*b*; 10*d*; 10*e*) embodied as an angle grinder comprising a guard attachment device; and a guard (14*b*; 14*d*; 14*e*) for attachment to a body (16*b*; 16*d*; 16*e*) of the power tool (10*b*; 10*d*; 10*e*) and for at least partially enclosing a rotating insertion tool that is insertable in the power tool (10*b*; 10*d*; 10*e*);

wherein the guard attachment device includes a fastening unit for attaching the guard (14*b*, 14*d*; 14*e*) to the body (16*b*; 16*d*; 16*e*) of the power tool (10*b*; 10*d*; 10*e*), wherein the fastening unit includes at least two detent elements (18*b*, 18*b*'; 18*d*, 18*d*'; 18*e*, 18*e*') for preventing the guard (14*b*; 14*d*; 14*e*) from rotating relative to the body (16*b*; 16*d*; 16*e*) of the power tool (10*b*; 10*d*; 10*e*);

wherein the at least two detent elements (18*b*, 18*b*'; 18*d*, 18*d*'; 18*e*, 18*e*') are mirror-symmetrically and movably arranged on the tool body (16*b*; 16*d*; 16*e*);

wherein the fastening unit further includes at least two handling elements (20*b*, 20*b*'; 20*d*, 20*d*'; 20*e*, 20*e*') designed as levers, wherein the at least two handling elements (20*b*, 20*b*'; 20*d*, 20*d*'; 20*e*, 20*e*') designed as levers are provided for manually releasing a snap-in connection established by the detent elements (18*b*, 18*b*'; 18*d*, 18*d*'; 18*e*, 18*e*') between the body (16*b*; 16*d*; 16*e*) of the power tool (10*b*; 10*d*; 10*e*) and the guard (14*b*; 14*d*; 14*e*);

wherein to each of the at least two detent elements (18*b*, 18*b*'; 18*d*, 18*d*'; 18*e*, 18*e*') one of the at least two handling elements (20*b*, 20*b*'; 20*d*, 20*d*'; 20*e*, 20*e*') designed as levers is assigned;

wherein the guard includes detent recesses (34*b*; 34*d*; 34*e*) in which the detent elements (18*b*, 18*b*'; 18*d*, 18*d*'; 18*e*, 18*e*') engage in at least one state of operation for preventing the guard (14*b*; 14*d*; 14*e*) from rotating relative to the body (16*b*; 16*d*; 16*e*) of the power tool (10*b*; 10*d*; 10*e*); and wherein each of the recesses (34*b*; 34*d*; 34*e*) is assigned to a rotation position of the guard (14*b*; 14*d*; 14*e*) relative to the body (16*b*; 16*d*; 16*e*).

11. The guard attachment device as recited in claim 1, wherein each of the at least two handling elements (20*b*, 20*b*') comprises an engagement region (36*b*, 36*b*'), wherein the engagement regions (36*b*, 36*b*') are located directly next to each other to achieve simultaneously releasing of the at least two detent elements (18*b*, 18*b*') by simultaneously pressing the engagement regions (36*b*, 36*b*') of the at least two handling elements (20*b*, 20*b*').

12. The guard attachment device as recited in claim 1, wherein each of the at least two handling elements (20*d*, 20*d*'; 20*e*, 20*e*') comprises an engagement region (36*d*, 36*d*'; 36*e*, 36*e*'), wherein the engagement regions (36*d*, 36*d*'; 36*e*, 36*e*') are displaced radially outwards relative to the body (16*d*; 16*e*) of the power tool (10*d*; 10*e*).

13. The guard attachment device as recited in claim 12, wherein the engagement regions (36*d*, 36*d*'), in respective release positions, abut a housing (38*d*) of the power tool (10*d*).

14. The guard attachment device as recited in claim 12, further comprising at least two spring elements (26*e*, 26*e*'), wherein each of the spring elements (26*e*, 26*e*') is located between one of the engagement regions (36*e*, 36*e*') and an external wall of a housing (38*e*) of the power tool (10*e*) to load the at least two handling elements (20*e*, 20*e*') with a spring load in a direction of a detent position of the at least two detent elements (18*e*, 18*e*').

15. The guard attachment device as recited in claim 14, wherein the spring elements (26*e*, 26*e*') are embodied as compression springs.

16. A guard attachment device, comprising:

a fastening unit for attaching a guard (14*b*), which is provided to partially enclose a rotating insertion tool, to a body (16*b*) of a power tool (10*b*);

wherein the fastening unit includes at least two handling elements (20*b*, 20*b*') designed as levers, wherein the fastening unit further includes at least two detent elements (18*b*, 18*b*') for preventing the guard (14*b*) from rotating relative to the body (16*b*) of the power tool (10*b*);

wherein the at least two detent elements (18*b*, 18*b*') are mirror-symmetrically and movably arranged on the tool body (16*b*);

wherein the at least two handling elements (20*b*, 20*b*') are provided for manually releasing a snap-in connection established by the detent elements (18*b*, 18*b*') between the body (16*b*) of the power tool (10*b*) and the guard (14*b*);

wherein to each of the at least two detent elements (18*b*, 18*b*') one of the at least two handling elements (20*b*, 20*b*') is assigned, wherein each of the at least two handling elements (20*b*, 20*b*') comprises an engagement region (36*b*, 36*b*'), wherein the engagement regions (36*b*, 36*b*') of each of the at least two handling elements (20*b*, 20*b*') are located directly next to each other along a circumferential direction to achieve simultaneously releasing of the at least two detent elements (18*b*, 18*b*') by simultaneously pressing the engagement regions (36*b*, 36*b*') of the at least two handling elements (20*b*, 20*b*'), and wherein the circumferential direction is arranged in a plane perpendicular to a rotation axis of the insertion tool.

17. A guard attachment device as defined in claim 16, wherein the at least two handling elements (20*b*, 20*b*') are mirror-symmetrically on the tool body (16*b*).

18. A guard attachment device, comprising:

a fastening unit for attaching a guard (14*d*; 14*e*), which is provided to partially enclose a rotating insertion tool, to a body (16*d*; 16*e*) of a power tool (10*d*; 10*e*);

wherein the fastening unit includes at least two handling elements (20*b*, 20*b*'; 20*d*, 20*d*'; 20*e*, 20*e*') designed as levers, wherein the fastening unit further includes at least two detent elements (18*d*, 18*d*'; 18*e*, 18*e*') for preventing the guard (14*d*; 14*e*) from rotating relative to the body (16*d*; 16*e*) of the power tool (10*d*; 10*e*);

wherein the at least two detent elements (18*d*, 18*d*'; 18*e*, 18*e*') are mirror-symmetrically and movably arranged on the tool body (16*d*; 16*e*);

wherein the at least two handling elements (20*d*; 20*e*) are provided for manually releasing a snap-in connection established by the detent elements (18*d*, 18*d*'; 18*e*, 18*e*') between the body (16*d*; 16*e*) of the power tool (10*d*; 10*e*) and the guard (14*d*; 14*e*);

wherein to each of the at least two detent elements (18*d*, 18*d*'; 18*e*, 18*e*') one of the at least two handling elements (20*d*, 20*d*'; 20*e*, 20*e*') is assigned, wherein each of the at least two handling elements (20*d*, 20*d*'; 20*e*, 20*e*') comprises an engagement region (36*d*, 36*d*'; 36*e*, 36*e*'), wherein the engagement regions (36*d*, 36*d*'; 36*e*, 36*e*') of each of the at least two handling elements (20*d*, 20*d*'; 20*e*, 20*e*') are displaced radially outwards relative to the body (16*d*; 16*e*) of the power tool (10*d*; 10*e*), and wherein the engagement regions (36*d*, 36*d*'; 36*e*, 36*e*') are displaced along a circumferential direction in an angle of about 180 degrees relative to each other.

19. A guard attachment device as defined in claim 18, wherein the at least two handling elements (20*b*, 20*b*') are mirror-symmetrically on the tool body (16*d*; 16*e*).

* * * * *